US009592175B2

(12) United States Patent
Soulakis

(10) Patent No.: US 9,592,175 B2
(45) Date of Patent: Mar. 14, 2017

(54) MOBILE CRUTCH

(71) Applicant: Manuel Michael Soulakis, Arvada, CO (US)

(72) Inventor: Manuel Michael Soulakis, Arvada, CO (US)

( * ) Notice: Subject to any disclaimer, the term of this patent is extended or adjusted under 35 U.S.C. 154(b) by 0 days.

(21) Appl. No.: 14/544,746

(22) Filed: Feb. 12, 2015

(65) Prior Publication Data

US 2016/0058648 A1 Mar. 3, 2016

Related U.S. Application Data

(60) Provisional application No. 62/070,604, filed on Sep. 2, 2014.

(51) Int. Cl.
*A61H 3/02* (2006.01)
*A61H 3/04* (2006.01)

(52) U.S. Cl.
CPC ..... *A61H 3/02* (2013.01); *A61H 3/04* (2013.01); *A61H 2003/046* (2013.01)

(58) Field of Classification Search
CPC ... A61H 3/00; A61H 3/02; A61H 3/04; A61H 3/0288; A61H 2003/0216; A61H 2003/046
USPC ..... 135/68, 70, 84, 85; 482/67, 68; 280/87.021
See application file for complete search history.

(56) References Cited

U.S. PATENT DOCUMENTS

| | | | | | |
|---|---|---|---|---|---|
| 1,757,784 | A * | 5/1930 | Smoot | 482/67 | |
| 1,917,440 | A * | 7/1933 | Finkbeiner et al. | 297/6 | |
| 2,244,869 | A * | 6/1941 | Everest et al. | 135/68 | |
| 2,297,173 | A * | 9/1942 | Shipman et al. | 482/67 | |
| 2,667,914 | A * | 2/1954 | Forbes | 482/67 | |
| 2,732,004 | A * | 1/1956 | Forbes | 482/67 | |
| 4,029,311 | A * | 6/1977 | Chanslor | A61H 3/04 188/29 | |
| 4,838,291 | A * | 6/1989 | DiVito | 135/68 | |
| 4,962,781 | A * | 10/1990 | Kanbar | 135/65 | |
| 6,003,532 | A * | 12/1999 | Pi | 135/67 | |
| 6,068,273 | A * | 5/2000 | Rao et al. | 280/87.041 | |
| 6,217,056 | B1 * | 4/2001 | Tsuchie | 280/639 | |
| 7,261,114 | B2 * | 8/2007 | Karasin et al. | 135/85 | |
| 9,016,297 | B2 * | 4/2015 | Salomon | 135/66 | |
| 2012/0139202 | A1 * | 6/2012 | Sigbjornsson | 280/47.34 | |

* cited by examiner

*Primary Examiner* — Noah Chandler Hawk

(57) ABSTRACT

A mobile crutch to facilitate improved ambulation of an impaired individual. The device includes a substantially rectangular vertical frame having two parallel vertical frame members, two transverse horizontal frame members, two rigid wheel assemblies, a handle and a brake. The mobile crutch is made from commercially available components. The mobile crutch includes wheels adjacent to the ground attached to the bottoms of the vertical members. The wheels allow the user, supported by the rigid arm rest, to maintain continuous ground contact and walk in an upright posture with uninterrupted strides.

4 Claims, 5 Drawing Sheets

MOBILE CRUTCH

FIELD OF THE INVENTION

The submitted invention relates to the assistance provided to an impaired individual by appliances such as a cane, walking stick, elbow crutch, standard crutch or other similar ground contact devices.

BACKGROUND OF THE INVENTION

Impaired individuals rely on aids to facilitate ambulation due to multiple causes such as injury, disease, partial paralysis, balance issues, excessive weight, advancing age and other limiting conditions that may significantly impact an individual's mobility.

Partially impaired individuals afflicted with these conditions may utilize a variety of devices facilitate their mobility such as canes, walking sticks, ski poles, elbow crutches, standard crutches and similar devices assist an individual's walking, standing and balance. These devices require a step-by-step process wherein the individual applies the support of the device and then extends a leg, and then relies on the support of the device repetitively to assist their mobility.

The step-by-step ambulation process utilizing a cane, standard crutches, etc. presents a controlled sequence of movement which requires lifting and advancing the position of the device repetitively before forward movement is accomplished. As the appliances of the type described above require step-by-step advancement, there remains a need for a device that will maintain continuous ground contact and facilitate uninterrupted ambulation. The impaired individual is supported while walking and maintaining a generally upright position thus conserving energy and eliminating stooping and associated awkwardness while enhancing the individual's mobility and comfort.

SUMMARY OF THE INVENTION

The present invention includes a structure for facilitating continuous upright ambulation by an impaired individual that consists of the following:

- A structure consisting of two parallel vertical members connected laterally by several transverse members to create a rigid frame.
- A transverse member connecting two parallel vertical frame members laterally across the top of the structure that serves as a means of support when the top transverse member of the mobile crutch is fitted under the arm of the individual.
- A second lateral member which is generally adjustable connects the parallel vertical frame members shafts at about the mid-length point of the structure. The transverse mid-length member is adjustable to accommodate the individual's arm length and their ability to grip the middle lateral member.
- A third lateral transverse segment connects the parallel vertical frame members at a level below the mid-level transverse member and above the level of the wheel housings thereby providing structural integrity to the frame.
- Rollable wheels are generally connected to the bottom of each vertical shaft by insertion of the wheel housing stem into the hollow bottom of each parallel vertical shaft. Wheel housings also may be attached to the bottom of the vertical shafts by alternative means described below.
- If the crutch is of solid material or the bottom of the individual shaft member is sealed, the shaft leg may be inserted into an embracing hollow socket type receptacle.
- Rollable wheels attached to the vertical shafts may be of various designs and may embody a single wheel or a multiple wheel carriage of the type often utilized for orthopedic walkers.

DETAILED DESCRIPTION OF PREFERRED EMBODIMENTS

Figure 1:
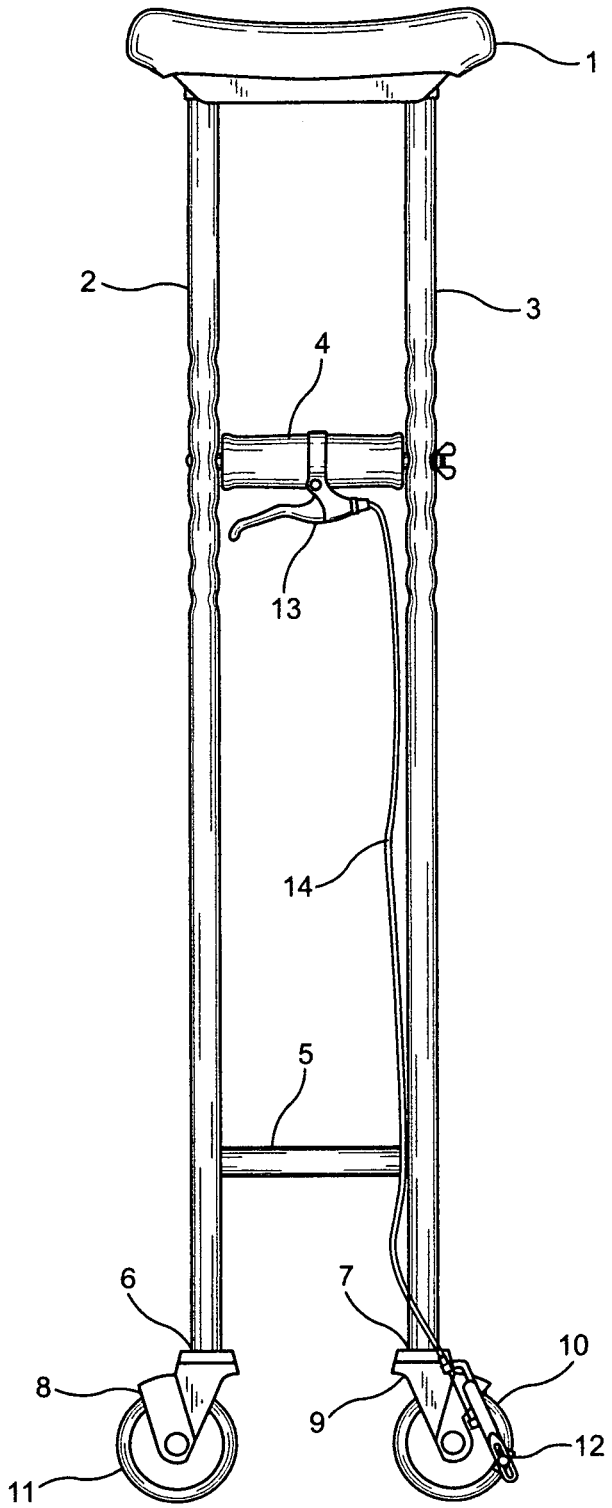
FIG. 1. Is a complete view of essential aspects and embodiments of the present invention and demonstrates a hand grip activated cable mechanism that asserts pressure on wheel braking pads to control movement of the mobile crutch.

Referencing a more detailed description of the figures starting with FIG. 1 which depicts the mobile crutch with rollable wheel embodiments 10 and 11 generally attached to the bottom of each parallel vertical leg member 2 and 3. The vertical leg members 2 and 3 are generally joined to the transverse arm support 1 and extend from 1 at the top of the shaft to the top of the wheel assembly 8 and 9.

A lateral member 1 connected at the top to parallel vertical leg members 2 and 3 is the initial support embodiment for an individual standing in a generally upright position while supported by the mobile crutch.

Parallel vertical leg members 2 and 3 are connected by a transverse horizontal member 4. Horizontal transverse member 4 is used as a hand grip to support the weight of the individual and as a means to enhance the individual's ability to maintain balance. The horizontal hand grip 4 also provides a means of guiding and turning the mobile crutch and most importantly, hand grip 4 enhances the individual's ability to maintain the crutch in a generally vertical and secure position close to the body, to maintain control of the mobile crutch and to facilitate ambulation in the desired direction. Embodiments 13 and 14 generally describe a squeeze and release hand brake mechanism embodying a cable system that generally engages brake pads 12 on each side of the wheel to apply pressure to the wheel 10 to slow or stop the motion of the mobile crutch facilitating controlled movement over obstacles such as curbs or when ascending or descending slopes or steps or when moving on motorized walkways, escalators etc. A horizontal transverse member 5 connects vertical leg members 2 and 3 in the lower section of the mobile crutch to provide structural support. Leg segments at point 6 and 7 are separately identified to indicate the insertion points of the wheel stem into the open end of the shaft. Located below transverse member 5 is leg segment 6 to which wheel apparatus 11 is attached and leg segment 7 to which wheel assembly 10 is attached.

Figure 2:
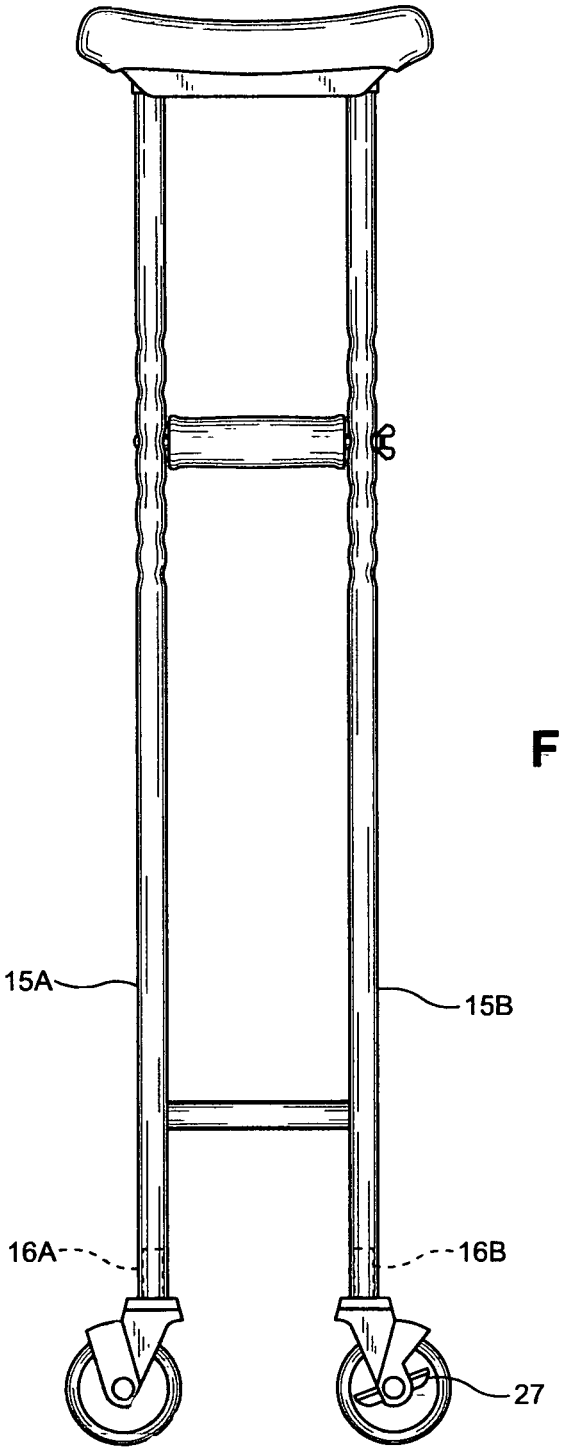
FIG. 2 Is a view of the stem of the wheel housing as inserted into the bottom of the vertical hollow shaft member.

Vertical shaft members shown in FIG. 2 are generally joined to the wheel apparatus as shown in the figure by inserting wheel housing stems 16 A and 16 B into the vertical leg shafts 15A and 15B respectively. FIG. 2 demonstrates a generally lower cost optional foot operated push and release type brake mechanism 27 that may be utilized to control movement.

Figure 3:
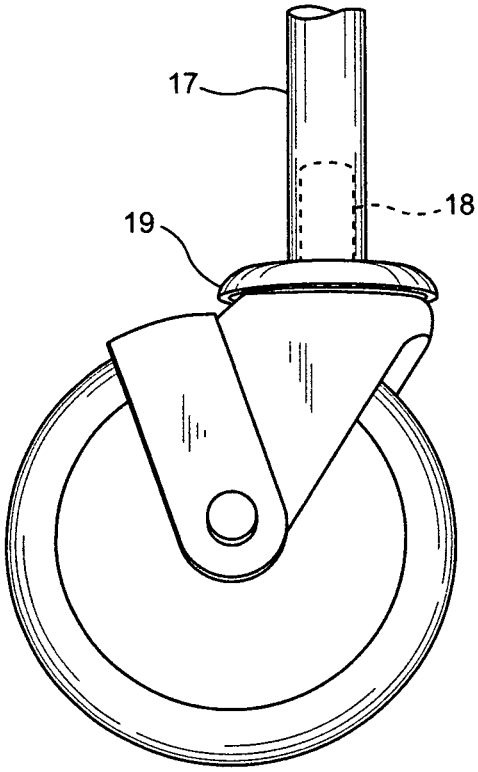
FIG. 3. Embodies the rear facing wheel which may be free to oscillate and so enhance the ease of change in direction and maneuverability of the mobile crutch.

FIG. 3 generally describes a rear facing wheel assembly 19 and shows the inserted wheel housing stem at the point of insertion 18 into the parallel shaft 17. The wheel housing embodies the rear facing wheel 19 which may be free to oscillate and so enhance the ease of change in direction and maneuverability of the mobile crutch.

Figure 4:
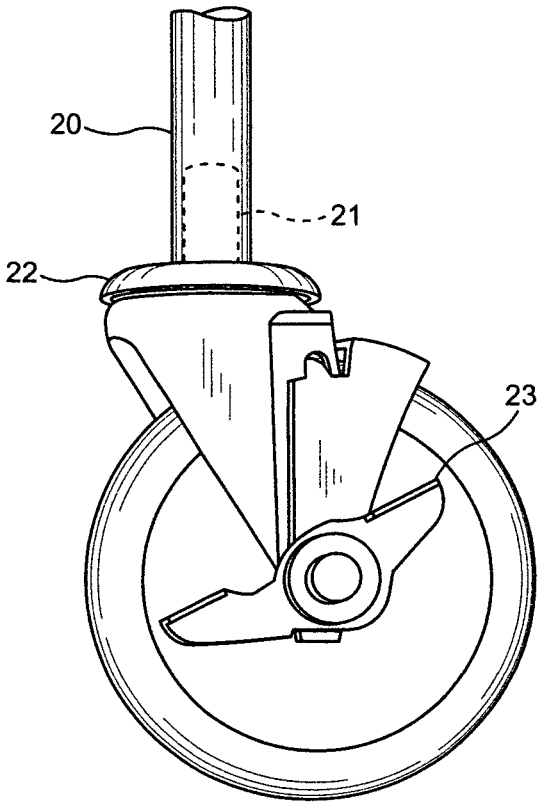
FIG. 4. Shows a view of a fixed forward facing stem type wheel housing 22 inserted into hollow leg shaft 20 and a wheel with an embodied foot operated push and release type brake 23.

FIG. 4 shows a generally forward facing fixed wheel housing 22 with wheel stem 21 in this example inserted into a hollow parallel frame shaft 20. The forward facing wheel is fixed and positioned in the desired direction of motion and prevents oscillation of the wheel which would require frequent correction of direction and may increase the potential for loss of support or precipitate a preventable fall. The forward wheel may embody an optional foot operated push and release type brake 23.

Figure 5:
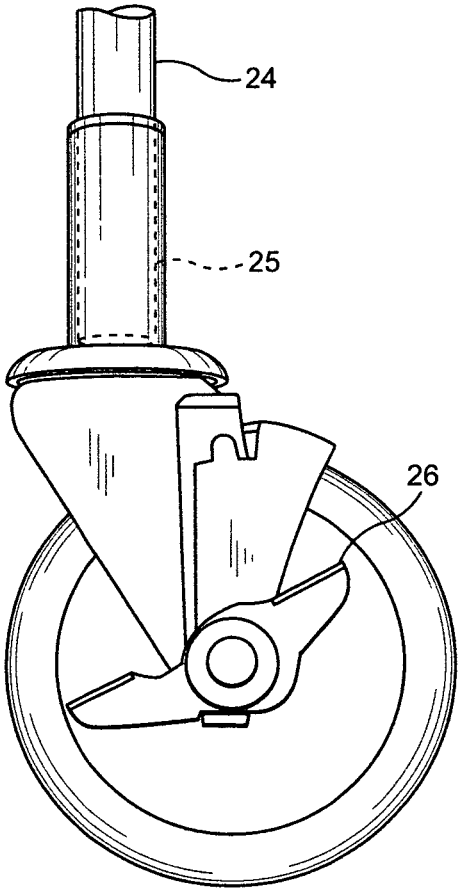
FIG. 5. Shows a view of a vertical shaft member that may be made of solid material or where the bottom of the shaft may be sealed. In these instances, the vertical frame shaft may be inserted and secured into an embracing socket type receptacle.

FIG. 5 addresses the instance where frame, shaft and other structural parts may be constructed of solid material such as wood, plastic, composite, PVC etc. or the bottom of the hollow shafts may be sealed preventing insertion of the wheel housing into the vertical leg segment. In this instance, the wheel housing may embody an embracing socket type receptacle. The vertical shaft member 24 may be inserted into embracing socket type receptacle 25 which generally is embodied at the top portion of the wheel housing apparatus. The instant depiction includes an example of a low cost foot operated push and release type brake mechanism 26 which may be offered as a low cost option. Each type of connective method, inserted wheel housing or embracing hollow socket may generally be secured to the bottom frame member segments 6 and 7 by a variety of methods utilizing among others: nut and bolt, grip ring, expanding rubber stem, threaded stem, weld, industrial adhesives and others.

Attached to each parallel vertical shaft at segments 6 and 7 by the methods described in the previous paragraph are the wheel apparatuses 10 and 11. The functional elements of the wheel apparatuses 10 and 11 are described in the following section.

Functional Elements and Attributes of Wheel Attachments

Wheel 10 utilized in the invention is held in a fixed position so that the housing 9 and wheel 10 are positioned in the direction of the intended movement. At the point wheel 10 is adjacent to the ground, it is held steady by the individual utilizing hand grip 4 to direct the mobile crutch in the actual or intended direction of travel. Wheel 11 is adjacent to the ground and follows wheel 10 but works independently and is free to oscillate and facilitates turns in direction. Together, simultaneous ground contact by wheels 10 and 11 provide an evenness and continuity of travel and enhance the feeling of balance and security that may not be provided by a cane, standard crutches or a one wheel crutch configuration. Generally wheels 10 and 11 may be comprised of a variety of commercially available wheels of varying designs. A single wheel for each leg shaft may be employed or dual or multiple wheel configurations may be employed based on individual usage and personal preference if multiple wheel type apparatus are viewed as providing better balance. The wheels 10 and 11 may be composed of various materials such as soft rubber, hard rubber, plastic, metal parts, bonded material, composite or other preferred material.

What is claimed:

1. A mobile crutch consisting essentially of:

a forward vertical hollow frame member and a rear vertical hollow frame member, wherein the forward and rear vertical hollow frame members are parallel, each member having a rigid wheel assembly attached to the bottom of the member, wherein the rigid wheel assemblies of the forward and rear frame members are parallel and aligned;

one transverse horizontal handle joined to the parallel vertical frame members at a location adapted to be gripped by a user;

two transverse horizontal frame members;

wherein one of said transverse horizontal frame members is joined to the tops of the said parallel vertical frame members to form a shoulder-high rigid arm rest;

wherein the other of said transverse horizontal frame members is joined to the parallel vertical frame members at a location below the handle and above the rigid wheel assemblies; and a brake assembly comprising a brake attached to the bottom of the forward parallel vertical frame member and a lever to slow or stop movement of the mobile crutch when a force is applied on said lever, and mobility of the mobile crutch is restored when the force is removed or an opposite force is applied to the brake lever.

2. The mobile crutch of claim 1, wherein the brake assembly is a footbrake attached to the bottom of the forward parallel vertical frame member; the footbrake consisting of a lever to slow or stop movement of the mobile crutch when a downward force is applied on said lever, and mobility of the mobile crutch is restored when an upward force is applied to the brake lever.

3. The mobile crutch of claim 1, wherein the brake assembly has a lever attached to the horizontal handle for actuating the brake.

4. The mobile crutch of claim 1 wherein the lower transverse horizontal frame member located above the rigid wheel assemblies can be inscribed with identity information, security codes or a logo.

* * * * *